US006692634B1

(12) United States Patent
Yakovlevich et al.

(10) Patent No.: US 6,692,634 B1
(45) Date of Patent: Feb. 17, 2004

(54) METHOD FOR MODIFYING OF HYDROCARBON FUEL AND DEVICES FOR MODIFYING HYDROCARBON FUEL

(75) Inventors: Leonid Yakovlevich, Moscow (RU); Andrei Grigorievich Lyapin, Moscow (RU)

(73) Assignee: Leonid Yakovlevich Gandelman, Moscow (RU)

( * ) Notice: Subject to any disclaimer, the term of this patent is extended or adjusted under 35 U.S.C. 154(b) by 64 days.

(21) Appl. No.: 10/110,875

(22) PCT Filed: Sep. 25, 2000

(86) PCT No.: PCT/RU00/00380

§ 371 (c)(1),
(2), (4) Date: Apr. 16, 2002

(87) PCT Pub. No.: WO01/29153

PCT Pub. Date: Apr. 26, 2001

(30) Foreign Application Priority Data

Oct. 20, 1999 (RU) ..... 99121719

(51) Int. Cl.[7] ..... C10G 35/00; B01J 19/08

(52) U.S. Cl. ..... 208/133; 208/157; 208/158; 422/186; 422/186.04; 422/186.08; 422/186.07

(58) Field of Search ..... 208/133, 157, 208/158; 422/186, 186.04, 186.08, 186.07

(56) References Cited

U.S. PATENT DOCUMENTS 4,334,889 A 6/1982 Takabayashi

FOREIGN PATENT DOCUMENTS

| | | |
|---|---|---|
| DE | 31 51 614 | 8/1982 |
| JP | 58-180593 | 10/1983 |
| RU | 95107109 | 6/1996 |
| RU | 2078977 | 5/1997 |
| RU | 2126094 | 2/1999 |
| WO | 98/47982 | 10/1998 |

*Primary Examiner*—Walter D. Griffin
*Assistant Examiner*—James Arnold, Jr.
(74) *Attorney, Agent, or Firm*—Katten Muchin Zavis Rosenman

(57) ABSTRACT

The invention relates to chemistry and in particular to technology for processing hydrocarbon fuel, including engine fuel. The invention makes it possible to obtain a fuel with high cetane and octane numbers by means of the following: the initial fuel supply occurs simultaneously with ejection; an ozone containing gas is fed into the ejection area; turbulent flows are created by displacement of such a mixture; the transformed mixture is directed into a volume with a stable pressure level; and thermodynamic equalization of the mixture parameters is achieved. During thermodynamic equalization, sprayed water is injected into said mixture. The inventive process is implemented by means of devices provided with an ejector, whereby said ejector has a suction pipe connected to an ozone generator, an input connected to initial fuel supply source and an output connected to an apparatus for the enrichment and transformation of fuel, whereby said apparatus comprises serially connected flow-through cylindrical chambers, between which an electrohydrodynamic flow converter is located, and one or two chambers for thermodynamic equalization. In such a case, the device is provided with a spray water supply source and with an electrohydrodynamic separator.

25 Claims, 2 Drawing Sheets

Amendment page (rule 26)

METHOD FOR MODIFYING OF HYDROCARBON FUEL AND DEVICES FOR MODIFYING HYDROCARBON FUEL

TECHNICAL FIELD

This inventions relate to chemistry and, in particular, to a technology for processing hydrocarbon fuel and can be used for the production of different kinds of fuel, for example, in the fuel and oil refining industry.

BACKGROUND OF THE INVENTION

Known in the art are technologies for processing different types of hydrocarbon fuels including the stage of treating the initial product with air oxygen in the presence of catalysts, the process being effected in an installation having a fuel tank with catalyst elements and devices for a supply of oxygen-containing gas (cf. Russian Federation patent No. 2110555 published on May 10, 1998). Furthermore, similar technologies realized in the above devices require adding special chemical agents to the initial hydrocarbon fiel (cf. Russian Federation patent No. 2109033 published on Apr. 20, 1998).

In this case, the process of fuel treatment involves high costs due to the use of catalysts and chemical additives and often takes a long cycle time. The increase of the octane number is achieved by isolating sulfur and lead salts and heavy metals from the fuel and converting some of the heavy hydrocarbons into light distillates, which may lead to significant losses of the resulting fuel (up to 50–60% of the initial volume).

Known in the art is a method of chemical modification of hydrocarbon fuel, in which fuel and ozone-containing gas are fed into a flow-through chamber, where they are agitated to obtain a biphase mixture, which is then converted with isolation of the final product (Russian Federation patent No. 1754762 IPC C106 7/00).

Known in the art is a device for chemical modification of hydrocarbon fuel comprising an initial fuel supply source, an ozone generator, an initial fuel conversion unit and a tank for finished fuel (Russian Federation patent No. 1754762 C 106 7/00).

The disadvantages of the known methods of chemical modification of hydrocarbon fuels and devices for their realization consist in significant power consumption, complex design due to the high pressure employed, poor quality of the final product and low fuel processing efficiency. Because of the low efficiency, the process requires additional treatment using chemical reagents and pyrolysis. Since the system operates under high pressure, the devices have large dimensions and, therefore, low reliability.

DISCLOSURE OF THE INVENTION

The main object of the invention is to provide a method and devices for the chemical modification of hydrocarbon fuel for improving its quality and the activation of hydrocarbon fuel with an increase of the octane or cetane numbers, thus drastically reducing the content of harmful impurities in the exhaust in the process of fuel combustion.

This object is attained due to the fact that in the proposed method of chemical modification of hydrocarbon fuels, the fuel is ejected into a flow-through chamber, an ozone-containing gas is fed to the ejection zone producing turbulent flows in the form of a biphase mixture, and the converted mixture is fed into a tank having a stable pressure level, the mixture parameters being thermodynamically equalized.

In so doing, turbulent flows of the biphase mixture are generated by passing this mixture through a high electric field with unipolar current pulses, said turbulent flows being created in the medium part of the flow-through chamber.

The object of the invention is also attained due to the fact that before generating the turbulent flows, a section is formed, in which the biphase mixture flow is twisted about the chamber axis, and the initial fuel is ejected into the flow-through chamber with a displacement in relation to its axis.

The object of the invention is also attained due to the fact that the converted mixture is filtered to remove foam, solid particles and aqueous hydroxide solutions of fuel impurities; the finished product is routed to the flow-through chamber input, and the process is repeated at least once.

The object of the invention is also attained due to the fact that during the thermodynamic equalization of the parameters sprayed water is injected into the biphase mixture and the obtained emulsion is subjected to A thermodynamic parameter equalization; after that hydrogenation and reduction are performed with A subsequent separation of the hydrocarbons into fractions.

In so doing the water to be sprayed is preheated and the biphase mixture is fed by sprays dispersed into nanomicron particles.

The object of the invention is also attained due to the fact that after the separation of the emulsion into hydrocarbon fractions these are filtered, separated, and the clean enriched liquid is fed to the flow-through chamber input, the process being repeated at least once.

The object of the invention is also attained due to the fact that after the hydrogenation and reduction the emulsion is subjected to an electrohydrodynamic separation and after that the activated portion of the mixture is fed to the flow-through chamber input, the process being repeated at least once.

The basic object of the invention is attained by providing a device for the chemical modification of hydrocarbon fuel comprising an initial fuel supply source, an ozone generator, a unit for the enrichment and conversion of the initial fuel and a final product tank, which has an ejector, a suction branch pipe connected to the ozone generator, the input is connected to the initial fuel supply source and the output to the unit for the enrichment and conversion of the initial fuel consisting of two flow-through cylindrical chambers connected in series, with a electrohydrodynamic flow converter and chambers for the thermodynamic equalization of the parameters inserted between them. In so doing the output of the final product tank may be connected to the initial fuel supply source.

The object of the invention is also attained due to the fact that the unit for the enrichment and conversion of the initial fuel is equipped with a filter based on the use of ion-exchange resins, the electrohydrodynamic flow converter has the form of a flow-through chamber with electrodes connected to an electric current source producing unipolar pulses, and the chamber for the thermodynamic equalization of the parameters has the form of a diffuser with a cylindrical chamber jointed thereto. In so doing at least one flow-through cylindrical chamber and/or the diffuser have electromagnetic flotation cells.

The object of the invention is also attained by providing a device for the chemical modification of hydrocarbon fuel comprising an initial fuel supply source, an ozone generator, initial fuel enrichment and conversion unit and a final product tank, which has an ejector whose suction branch pipe is connected to the ozone generator, the input is connected to the initial fuel supply source and the output is connected to the initial fuel enrichment and conversion unit made of two flow-through cylindrical chambers connected in series, with an electrohydrodynamic flow converter inserted between them, and at least two chambers for the thermodynamic equalization of the parameters, a water sprayer, a filter and an electrohydrodynamic separator, the outputs of the electrohydrodynamic separator being connected to the final product tank and to the initial fuel supply source.

The object of the invention is also attained due to the fact that the thermodynamic equalization chamber, which is located first in the path of the mixture flow, has the form of a diffuser affixed to a cylindrical chamber, and the second chamber has the form of a labyrinth with countercurrents. In so doing a filter may be installed between these chambers, the filter outputs being connected to the initial fuel supply source and to a deposit storage tank.

The claimed method and device for the chemical modification of hydrocarbon fuel make it possible to modify hydrocarbon stock fuel to obtain a high-quality fuel.

The use of the modified hydrocarbon fuel, for example, motor fuel, allows a drastic reduction of harmful impurities in the exhaust gases, such as sulfur, lead etc.

The proposed devices make it possible to realize the claimed method while producing high-quality fuel. In so doing the devices themselves are more technological than the known ones, feature higher reliability, because they allow the process to be effected under low pressures and temperatures thereby reducing the production cost, e.g. power consumption.

BRIEF DESCRIPTION OF THE DRAWINGS

The invention is further illustrated by examples with reference to the appended drawings (FIGS. 1 and 2), which show the schematics of two embodiments of the device for the chemical modification of hydrocarbon fuel.

THE BEST EMBODIMENTS OF THE INVENTION

Figure 1:
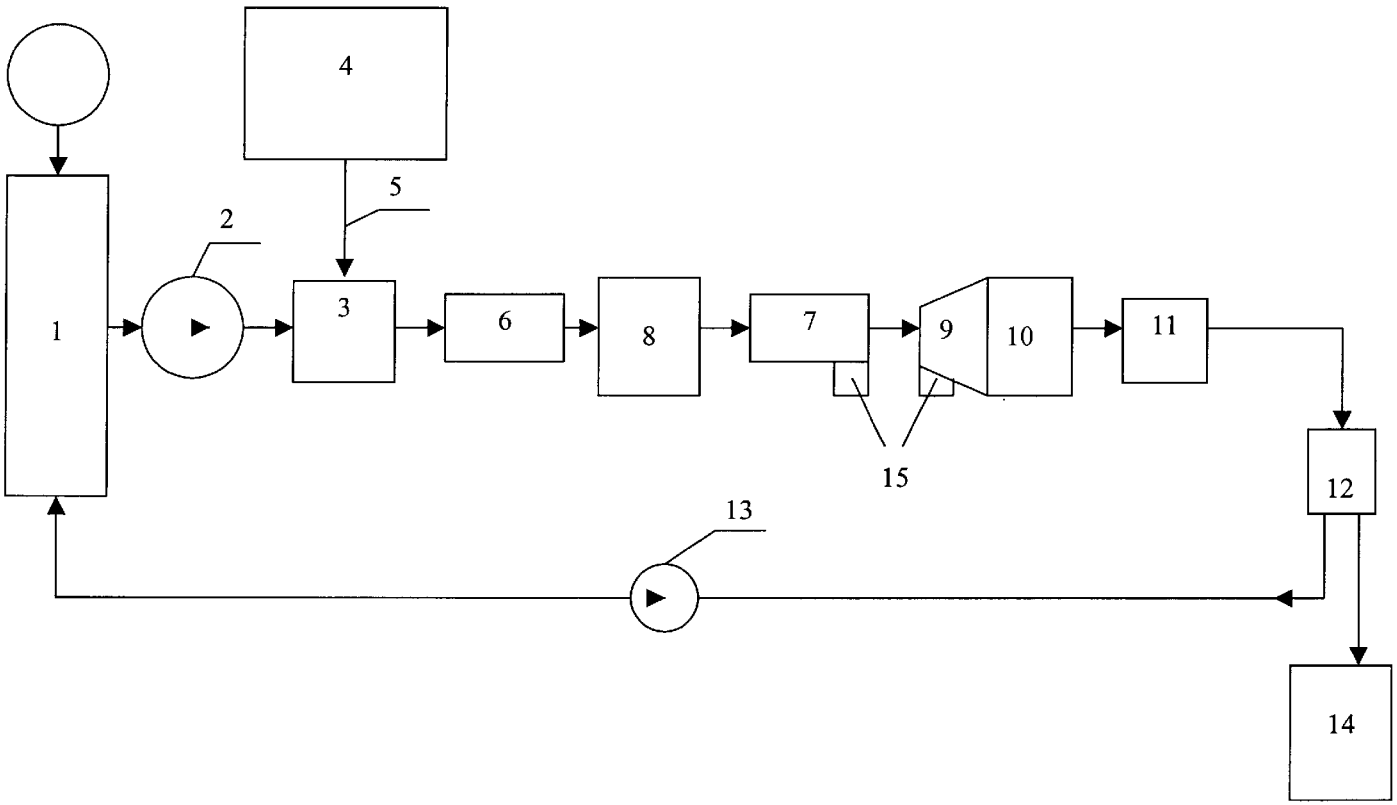
FIG. 1 is a block diagram of the device for the chemical modification of engine fuel.

The device for the chemical modification of engine fuel (FIG. 1) has the following design. An output of an initial fuel source 1 is connected to a pump 2 whose output is connected to an ejector 3. An ozone generator 4 is connected to a suction branch pipe 5 of the ejector 3. An initial fuel enrichment and conversion unit consists of two flow-through cylindrical chambers 6, 7 connected in series and an electrohydrodynamic flow converter 8 mounted between the chambers 6, 7. The flow-through cylindrical chamber 6 has an input connected to the ejector 3. The chamber for the thermodynamic parameter equalization consists of a diffuser 9 and a cylindrical chamber 10, affixed to the diffuser 9. The output of the cylindrical chamber 10 is connected to a multi-row granular-type filter 11 whose output is connected to a chamber 12 separating the converted mixture into two portions, one of which is pumped by a pump 13 through a pipeline into the initial fuel tank 1 and the other is pumped into a final final product tank 14.

The flow-through cylindrical chamber 7 and diffuser 9 are equipped with electromagnetic flotation cells 15 preventing the sticking of the mixture fractions to the chamber walls.

The device shown in FIG. 1 operates as follows.

The initial fuel is fed from a reservoir into the initial fuel tank 1, where it is preheated to 50°–80° C. depending on the fuel composition and then is pumped by the oil pump 2 at a preset flow rate $Q_p$ and a pressure $P_p$ to the input of the ejector 3, which is also supplied with an ozone-and-air or ozone-and-oxygen mixture at a flow rate $Q_H$ and a pressure $P_H$ from the generator 4 through the suction branch pipe 5. At the output of the ejector 3 the gas and fuel flows react with one another and are transformed into an emulsion in the biphase state. For this purpose, they are mixed in the cylindrical chambers 6–7. The emulsion residence time is controlled by varying the corona discharge intensity in the electrodynamic flow converter 8 thus varying the outflow velocity of the fluid from one part of the chamber 6 into the chamber 7 (according to the electronic lens law).

The diffuser 9 and the cylindrical chamber 10 produce an emulsion flow that is uniform through the whole section, moves at a definite velocity and has stable thermodynamic parameters. In this case, under the effect of chemical reactions, frictional electricity and the electroaerodynamic fields foam and various hydroxides are produced that precipitate onto the bottom.

To remove these components from the fuel, the emulsion is fed through the multi-row granular-type filter 11. After filtration, if the fuel has not achieved a required quality, it is pumped back by the pump 13 to the initial fuel tank completely or partially for reprocessing. At the same time, the foam and deposit are removed from the filter.

The finished new fuel is collected in the final product tank 14.

Figure 2:
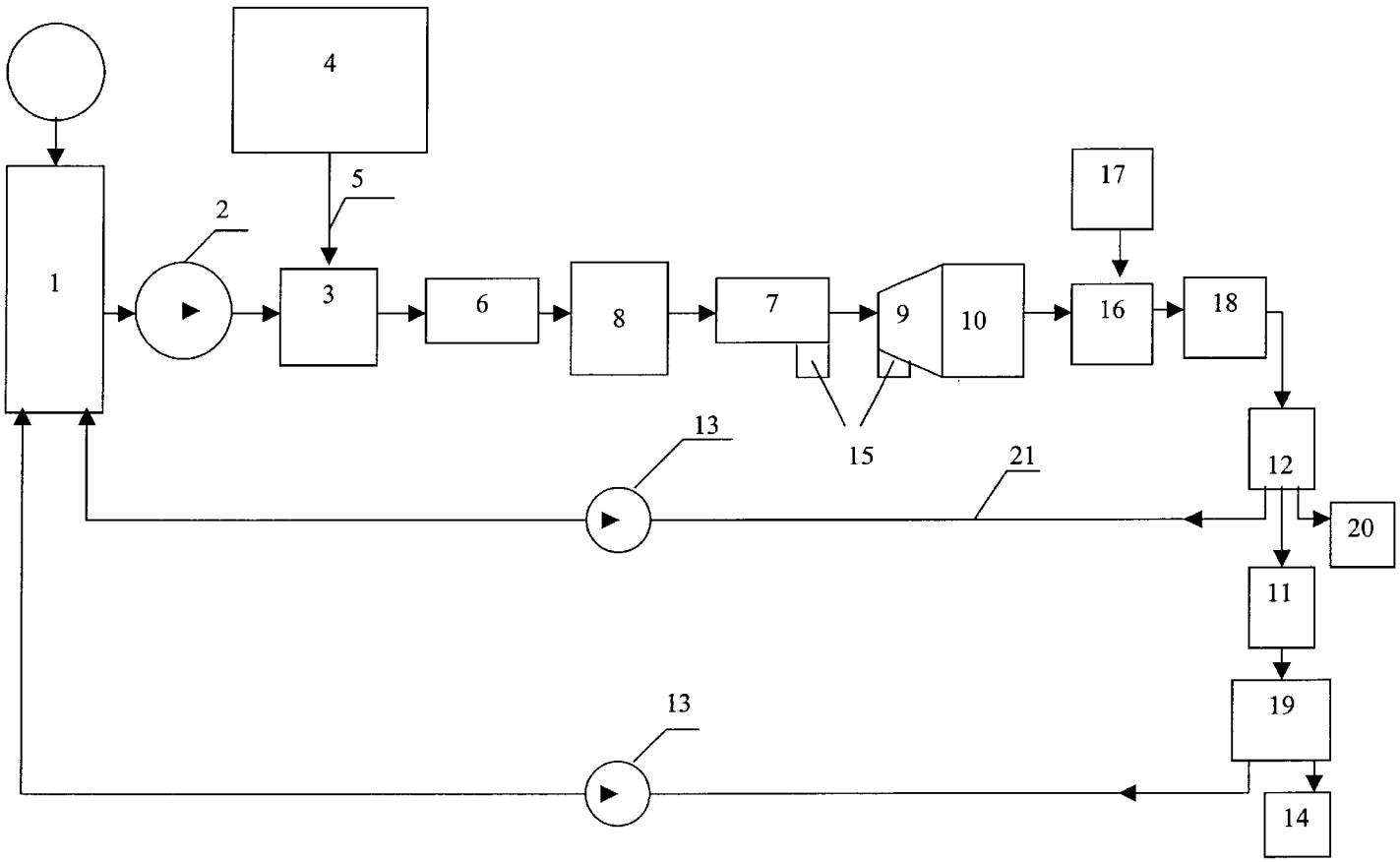
FIG. 2 is a block diagram of the device for the chemical modification of wide-range hydrocarbon fuels assuming that sprayed water is used in the process of chemical modification.

Another embodiment of the device for chemical modification hydrocarbon fuel is shown in FIG. 2. According to this embodiment, the device further comprises a sprayed water chamber 16 connected to a water supply and preheating system 17, a labyrinth 18 with countercurrents acting as a second chamber for thermodynamic equalization of parameters and an electrohydrodynamic separator 19 whose outputs are connected to the final product tank 14 and to the initial fuel tank 1 through a pump 13. The chamber 12 is connected through its second output to a storage container 20 for deposits and through a pipeline 21 to the initial fuel tank 1.

In contrast to the device described above (FIG. 1), the high efficiency of separation of the light hydrocarbons by processing any initial fuel of a petroleum product using the proposed method is achieved due to the fact that its technological scheme includes an element providing fine cleaning, emulsion enrichment and separation into fractions that is effected by means of an electrohydrodynamic separator 19 whose principle of operation is described in detail in the book by Olofinsky N. F. <<Electrical Methods of Enrichment>>, Moscow, Nerdra Publishers, 1977, page 17.

It is well known that particles of a medium in a gaseous or atomized phase influenced by an electric field acquire a surplus charge and a directed path of motion depending only on the physical and chemical properties of the material or averaged components of the medium in question. The medium particles, having a surplus charge or being charged, acquire properties of emulsions or aerosols. The use of aerosols in the processes of enrichment, cleaning and activation is stipulated by the fact that charging the particles and imparting to them a directed motion in an electric field in a gaseous working medium requires power consumption lower than the energy required for their movement and separation into a liquid (viscous) medium by several orders of magnitude.

The liquid fed into a typical electrohydrodynamic separator is sprayed by any known method and then is charged by a classical method of charging in a corona discharge, transferred to a precipitation electrode with simultaneous classification and split into fractions by weight and physical-and-chemical properties.

As a result, the application of the electrohydrodynamic separator makes it possible to easily separate the light hydrocarbons having the properties of a high-quality engine fuel to be collected in the tank 14. The heavy hydrocarbons, which are not converted during the available processing time, are fed back to the initial product tank 1 for A repeated reaction, and the deposit consisting of different hydroxides and foam is collected in the storage container 20.

It has been proved experimentally that the use of an electrohydrodynamic separator in the claimed device makes it possible to transform the emulsion treated by the proposed technique and to isolate up to 65–71% of the final product compared to the initial one.

The device operates as follows.

The initial fuel is poured or flows continuously by gravity into an initial fuel tank 1, where it is preheated to 50°–80° C. depending on the fuel chemical composition and type. From the tank 1 the fuel is pumped by the oil pump 2 at a preset flow rate $Q_p$, determined by the required output of the final fuel at the pressure $P_p$, to the input of the ejector 3, which is also supplied through a pipe branch 5 with an ozone-and-air or ozone-and-oxygen mixture generated by the ozone generator 4 with a predetermined ozone flow rate and concentration.

At the output of the ejector 3 the crossing flows of fuels and ozone-containing mixture come in chemical oxonolysis reactions. For the complete dissolution in the hydrocarbons, these reactions need certain time. For this purpose, these two flows are twisted and converted into a biphase state close to an emulsion with the help of the flow-through cylindrical chambers 6 and 7, the time control being effected by varying the turbulence via varying the corona discharge intensity in the typical electrohydrodynamic flow converter 8. For decreasing the speed of motion of the emulsion and for the thermodynamic equalization of its parameters, the device is provided with a diffuser 9 and a cylindrical chamber 10. At the output of this chamber 10 the flow velocity is practically constant throughout the whole section. In contrast to the device whose block diagram is shown in FIG. 1, in the device illustrated in FIG. 2 the processes of ozonolysis and conversion of fuel components into lighter fraction are intensified by injecting sprayed water preheated to 50°–70° C. into the fuel. The uniform flow of fuel with excessive oxygen-containing and components demonstrating tribological behavior is mixed with water in a chamber 16, and the water itself is prepared in a device 17. To maintain a required period of the oxonolysis and hydrogenation processes, the produced emulsion is fed from the chamber 16 into a labyrinth 18 made as a system with opposing streams providing an emulsion counterflow.

The chemical reactions result in the violent foaming and formation of metal hydroxides transforming into insoluble sulfates, paraffites and nitrites.

For this purpose, after the labyrinth 18 the emulsion is fed into a multi-row granular-type filter 11, where the deposit is collected in the container 20, a portion of the processed cleaned and enriched fuel is fed to the separation chamber 12 and then to the electrohydrodynamic separator 19 for the activation and complete separation into fractions.

A part of the emulsion which has not passed the complete cycle of oxonolysis and hydrogenation, is returned to the initial product tank 1 via a pipeline 21.

The heavy fractions produced by the electric separation are also fed back to the tank 1.

The obtained final (new) product with preset characteristic parameters is collected in tank 14.

The working volume of this tank is uniquely determined by the required productivity of the system.

The volumes of the cylindrical mixing chambers, thermodynamic equalization chambers, labyrinth, filter and electrohydrodynamic separator are selected depending on a possible water supply in an amount of up to 25% of the initial fuel and taking into account the foaming.

In order to confirm the correctness and workability, the proposed method and device have been tested in actual full-scale models of these devices, making it possible to process 100 liters of initial hydrocarbon fuel and to perform the treatment of a number of synthetic components and petroleum obtained from them.

The devices (FIG. 1 and FIG. 2) are used for the processing and chemical modification of fuel oil (black oil KT4VL), straight-run diesel oil DL with black oil VLT-4, high-quality diesel oil DG, straight-run petrol with a sublimating temperature $T_s$–90° C., and aviation kerosene RD.

The conducted tests confirm the efficiency of the claimed inventions.

As a result, in all the tested fuels treated according to the inventions it is possible to increase the octane or cetane number by 3 to 5 units while decreasing the mass portion of sulfur, to convert the mercaptan sulfur, to reduce the acid and KOH by a factor of 20, to increase the iodine number by 20–45%, to raise the alcohol content by 100 to 200 times, to increase the ester number by 50%, and to increase the hydroxyl number by 50%.

A positive fact is that, according to the claimed inventions, the enrichment, cleaning, and activation of fuels can be effected by heating the initial fuel to a maximum temperature of 80° C. at a pressure maximum 0.2 MPa while using atmospheric ozone and water in an amount of up to 20% per 100 liters of initial fuel. Numerous tests have shown that no water in present in the final fuel.

The same tests have shown that the collected deposit contains a sufficient amount of paraffites and aromatics requiring further processing.

INDUSTRIAL APPLICABILITY

The claimed inventions will find wide application at the petroleum processing plants, oil refineries, refueling stations and in chemical industry.

What is claimed is:

1. A method for modifying hydrocarbon fuel, in which the fuel and ozone-containing gas are fed to a flow-through chamber, said components being agitated to obtain a biphase mixture with subsequent conversion of the mixture and isolation of a final product, characterized by the fact that the fuel is fed by ejecting it into the flow-through chamber, and an ozone-containing gas is fed to the ejection zone, turbulent flows being formed in the biphase mixture during its motion in the flow-through chamber render, and the converted mixture is fed to a container with a stable pressure level, where occurs the thermodynamic equalization of the mixture parameters.

2. A method according to claim 1, characterized by the fact that the turbulent flows of the biphase mixture are formed by passing the mixture through a strong electric field with unipolar current pulses.

3. A method according to claim 1, characterized by the fact that before forming the turbulent flows there a section is created, in which the biphase mixture flows are twisted about the flow-through chamber axis.

4. A method according to claim 1, characterized by the fact that the turbulent flows of the biphase mixture, are formed in the middle part of the flow-through chamber.

5. A method according to claim 1, characterized by the fact that the fuel is ejected into the flow-through chamber with a displacement of the mixture in relation to the chamber axis.

6. A method according to claim 1, characterized by the fact that the converted mixture is filtered to remove the fuel impurities such as foam, solid inclusions and aqueous hydroxide solutions, the final product is fed to the flow-through chamber input and the process is repeated at least once.

7. A method according to claim 1, characterized by the fact that during the thermodynamic equalization of the mixture parameters sprayed water is injected into the biphase mixture and the resulting emulsion is subjected to thermodynamic equalization of parameters with hydrogenation and reduction followed by separation into hydrocarbon fractions.

8. A method according to claim 7, characterized by the fact that after the separation of the emulsion into hydrocarbon fractions, they are filtered, separated, and cleaned, and the clean enriched portion is fed to the flow-through chamber input, the process being repeated at least once.

9. A method according to claim 8, characterized by the fact that the spraying water is preheated.

10. A method according to claim 8, characterized by the fact that water sprayed to nanomicron dispersity is injected into the biphase mixture.

11. A method according to claim 8, characterized by the fact that the separation is electrodynamic.

12. A method according to claims 11, characterized by the fact that after the electrohydrodynamic separation the activated portion of the mixture is fed to the flow-through chamber input and the process repeated at least once.

13. A device for modifying hydrocarbon fuel comprising a initial fuel supply source, an ozone generator, an initial fuel enrichment and conversion unit and a final product tank, characterized by the fact that it is equipped with an ejector whose suction branch pipe is connected to the ozone generator, the input is connected to the fuel supply source, and the output is connected to the initial fuel enrichment and conversion unit consisting of two flow-through cylindrical chambers connected in series, with an electrohydrodynamic flow converter placed between them, and a chamber for thermodynamic equalization of the mixture parameters.

14. A device according to claim 13, characterized by the fact that the final product tank outlet is connected to the initial fuel supply source.

15. A device according to claim 13, characterized by the fact that the initial fuel enrichment and conversion unit is equipped with a filter based on ion-exchange resins.

16. A device according to claim 13, characterized by the fact that the electrodynamic flow converter has the form of a flow-through chamber with electrodes connected to an electrical current source generating unipolar pulses.

17. A device according to claim 13, characterized by the fact that the chamber for the thermodynamic equalization of the mixture parameters has the form of a diffuser with a cylindrical chamber affixed to it.

18. A device according to claim 13, characterized by the fact that at least one flow-through cylindrical chamber and/or diffuser are equipped with electromagnetic flotation cells.

19. A device for modifying hydrocarbon fuel comprising an initial fuel supply source, an ozone generator, an initial fuel enrichment and conversion unit and a final product tank, characterized by the fact that it comprises an ejector whose suction branch pipe is connected to the ozone generator, the input is connected to the initial fuel supply source, and the output is connected to a unit for the enrichment and conversion of the initial fuel which has the form of two flow-through cylindrical chambers connected in series, with an electrohydrodynamic flow converter placed between them, at least two chambers for the thermodynamic equalization of the parameters, a sprayed water supply device, a filter, and an electrohydrodynamic separator.

20. A device according to claim 19, characterized by the fact that the outputs of the electrohydrodynamic separator are connected to the final product tank and to the initial fuel supply source.

21. A device according to claim 19, characterized by the fact that the electrohydrodynamic flow converter has the form of a flow-through chamber with electrodes connected to the electrical current source generating unipolar pulses.

22. A device according to claim 15, characterized by the fact that the upstream chamber for the thermodynamic equalization of the mixture parameters has the form of a diffuser affixed to the cylindrical chamber.

23. A device according to claim 19, characterized by the fact that the downstream chamber for the thermodynamic equalization of the mixture parameters has the form of a labyrinth with counterflows.

24. A device according to claim 19, characterized by the fact that a filter is installed before the electrohydrodynamic separator, said filter having additional outputs connected to the initial fuel supply source and to a deposit storage container.

25. A device according to claim 19, characterized by the fact that at least one cylindrical flow-through chamber and/or a diffuser are provided with electromagnetic flotation cells.

* * * * *

UNITED STATES PATENT AND TRADEMARK OFFICE

CERTIFICATE OF CORRECTION

PATENT NO. : 6,692,634 B1
DATED : February 17, 2004
INVENTOR(S) : Gandelman et al.

It is certified that error appears in the above-identified patent and that said Letters Patent is hereby corrected as shown below:

Title page,
Item [12], should read: -- United States, Gandelman et al. --
Item [75], Inventors, first Inventor should read : -- Leonid Yakovlevich Gandelman --.

Column 1,
Line 21, reads "special chemical agents to the initial hydrocarbon fiel (cf." should read: -- special chemical agents to the initial hydrocarbon fuel (cf. --

Column 3,
Line 67, reads: "into a final final product tank 14." should read: -- into a final product tank 14. --

Signed and Sealed this

Eleventh Day of May, 2004

JON W. DUDAS
*Acting Director of the United States Patent and Trademark Office*